United States Patent [19]

Yoda

[11] Patent Number: 5,021,312

[45] Date of Patent: Jun. 4, 1991

[54] APPARATUS AND METHOD FOR CONTROLLING THE QUANTITY OF DEVELOPER DELIVERED TO A FILM PROCESSING HEAD

[75] Inventor: Akira Yoda, Kanagawa, Japan

[73] Assignee: Fuji Photo Film Co., Ltd., Kanagawa, Japan

[21] Appl. No.: 288,882

[22] Filed: Dec. 23, 1988

[30] Foreign Application Priority Data

Dec. 28, 1987 [JP] Japan ..... 62-335052

[51] Int. Cl.[5] ..... G03G 13/10

[52] U.S. Cl. ..... 430/97; 430/117; 355/214

[58] Field of Search ..... 430/97, 104, 117, 119; 355/214, 246

[56] References Cited

U.S. PATENT DOCUMENTS

| | | | |
|---|---|---|---|
| 3,782,818 | 1/1974 | Smith | 430/119 |
| 4,319,544 | 3/1982 | Weber | 430/117 |
| 4,514,480 | 4/1985 | Wada et al. | 430/97 |
| 4,640,603 | 2/1987 | Honma | 355/214 |
| 4,702,590 | 10/1987 | Usami | 355/214 |

*Primary Examiner*—John Goodrow

*Attorney, Agent, or Firm*—Sughrue, Mion, Zinn Macpeak & Seas

[57] ABSTRACT

A charged film is exposed to light from an image to record the image as a electrostatic latent image on the film. A developer is then fed to the film so that the film is developed. The feed quantity of the developer to the film is controlled in accordance with the light quantity at the time of the exposure. A developing apparatus is equipped with a sensor for detecting light from an image and a circuit for controlling the feed quantity of the developer to the film. It is hence possible to avoid feeding of excess developer to the film.

20 Claims, 10 Drawing Sheets

APPARATUS AND METHOD FOR CONTROLLING THE QUANTITY OF DEVELOPER DELIVERED TO A FILM PROCESSING HEAD

BACKGROUND OF THE INVENTION

1) Field of the Invention

This invention relates to process and apparatus for developing a film, on which an image recorded on an original has been recorded as an electrostatic latent image by charging and subsequent exposure, by feeding a developer to the film.

2) Description of the Related Art

Electrophotographic apparatus have been known which can record an image on a desired frame of an electrophotographic film and can project or copy the thus-recorded image.

In addition, processing heads which are each assembled in an electrophotographic apparatus to apply charging and exposure, development and the like to an electrophotographic film are known in U.S. Pat. Nos. 4,600,291 and 4,697,912, etc.

The processing head disclosed in each of the above patent publication is provided with charging and exposing zone, developing zone, drying zone and fixing zone. These zones are arranged side by side sequentially in the above order along the feeding direction of an electrophotographic film. The arrangement pitch of the individual zones is equal to the frame pitch of the electrophotographic film and is hence constant.

Let's assume that an electrophotographic film is subjected to normal development by the above apparatus. In the charging and exposing zone, the electrophotographic film positioned there, namely, one of the frames of the electrophotographic film is charged positive on the entire surface thereof and then exposed to transmitted or reflected light from an original which is referred as "image light" herein after. Owing to the exposure graphic film is neutralized at areas exposed to the light from the original but remains charged at areas not exposed to the light. As a result, an electrostatic latent image corresponding to the image pattern of the original is formed. In the developing zone, a developer is fed into the spacing between the electrophotographic film and a developing electrode and is allowed flow down through the spacing. Toner particles contained in the developer and charged negative are attracted to the positively charged surface while the developer flows down through the spacing, whereby the electrostatic latent image is made visible. In the drying zone, dry air is blown against the electrophotographic film wetted with the developer so that moisture is eliminated. In the fixing zone, the image is fixed on the electrophotographic film by a fixing lamp or the like.

The quantity of a developer required for the development of an electrostatic latent image formed on an electrophotographic film varies depending on the kind of the original. For example, in the case of an original in which black areas account for a large percentage of the overall image area, in other words, an original whose so-called optical density is high (photographes or contact prints), more toner particles are attracted. In contrast, in the case of an original in which black areas account for a small percentage of the overall image area, in other words, an original whose so-called optical density is low (general characters, drawings, newspapers), less toner particles are attracted. Accordingly, the quantity of the developer to be fed has heretofore been set at a level required for the development of an electrophotographic film exposed to light from an original of a high optical density, and the spacing between the electrophotographic film and a developing electrode has been set to a degree to sufficiently develop the image of the contact prints or the general characters by the quantity of the fed developer. For example, this spacing is set at 0.3–0.4 mm and the developer is fed in a quantity of 0.5 cc or so into the spacing.

When the quantity of the developer and the spacing are set in accordance with conditions for the development of a electrostatic latent image formed as a result of exposure to light from an original of a high optical density, such as a photograph or contact print, in other words, an original requiring toner particles in a large amount as described above, the development of an electrophotographic film exposed to light from an original of a low optical density, such as general characters, a drawing or a newspaper, encounters a problem that toner particles in the developer, said toner particles flowing down apart from the surface of the electrophotographic film, are not attracted onto the electrophotographic film and are allowed to flow away and the utilization factor of the developer is hence low. With a view toward solving this problem, it may be contemplated of reducing the spacing between the electrophotographic film and the developing electrode to improve the utilization factor of the developer. This approach is preferred as the developer can be saved. In addition, the reduced spacing between the developing electrode and the electrophotographic film makes it possible to feed the developer in a small quantity, whereby it is no longer required to recycle any excess developer to the developer bottle, in other words, the developer can be used in accordance with the so-called non-recycling or throw-away system and the processing of the spent developer can be facilitated.

When the spacing between the developing electrode and electrophotographic film is reduced and the quantity of the developer to be fed is reduced as described above, a film with an image of an original of a high optical density formed thereon through charging and exposure may however encounter a potential problem that toner particles may become scarce in absolute quantity because such a film requires lots of toner particles. In this case, the electrostatic latent image cannot be fully rendered visible, thereby resulting in another problem of development blurs.

It has hence been impossible to feed an optimum quantity of a developer to an electrophotographic film in accordance with the optical density of an original.

The problems referred to above arise in both normal and reversal developments.

SUMMARY OF THE INVENTION

With the foregoing in view, a principal object of the present invention is to provide developing process and an apparatus which can improve the utilization factor of a developer by feeding the developer only in a minimum necessary quantity and can surely develop a film exposed to image light from an original irrespective of the optical density of the original.

The developing process according to this invention features that when a film, on which an image recorded on an original has been recorded as an electrostatic latent image by charging and exposure, is developed by feeding a developer to the film, the quantity of the developer to be fed is controlled in accordance with the light quantity of image light from the original, said film having been exposed to the image light.

According to the present invention, when a film, on which an image recorded on an original has been recorded as an electrostatic latent image by charging and exposure, is developed by feeding a developer to the film, the quantity of the developer to be fed is controlled in accordance with the light quantity of image light from the original.

In the case of normal development by way of example, the light quantity of image light from an original is small where the original contains black areas in a high proportion relative to the entire image area, namely, has a high optical density. By increasing the feed quantity of a developer in accordance with the ratio of decreasing the light quantity, a film exposed to image light from the original of a high optical density can be developed without failure. Where an original contains black areas in a low proportion relative to the entire image area, namely, has a low optical density, the quantity of image light from the original is large. Hence, the feed quantity of the developer is reduced in accordance with the ratio of increasing the light quantity. In this manner, it is possible to avoid feeding of excess developer so that the developer can be saved.

In the case of reversal development on the other hand, feeding of excess developer can be avoided by reducing the feed quantity of the developer in accordance with the light quantity where the original has a high optical density. Where the original has a low optical density, its fail-free development is assured by increasing the feed quantity of the developer in accordance with the light quantity.

Further, the developing apparatus of this invention is equipped with a means for detecting the quantity of light from an original, a means for feeding a developer to a film, and a means for controlling the developer-feeding means in accordance with the light quantity so as to control the feed quantity of the developer. Therefore, the feed quantity of the developer can be controlled in accordance with the quantity of light from the original.

According to the present invention, the feed quantity of a developer is controlled in accordance with the light quantity of image light from an original, said image light being used for the exposure of a film. This invention has therefore brought about such excellent advantageous effects that the developer can be fed in a minimum necessary quantity to improve its utilization factor and the film exposed to the image light from the original can be developed without failure irrespective of the optical density of the original to ensure good development.

BRIEF DESCRIPTION OF THE DRAWINGS

The above and other objects, features and advantages of the present invention will become apparent from the following description and appended claims, taken in conjunction with the accompanying drawings, in which:

DETAILED DESCRIPTION OF THE INVENTION AND PREFERRED EMBODIMENTS

Figure 1:
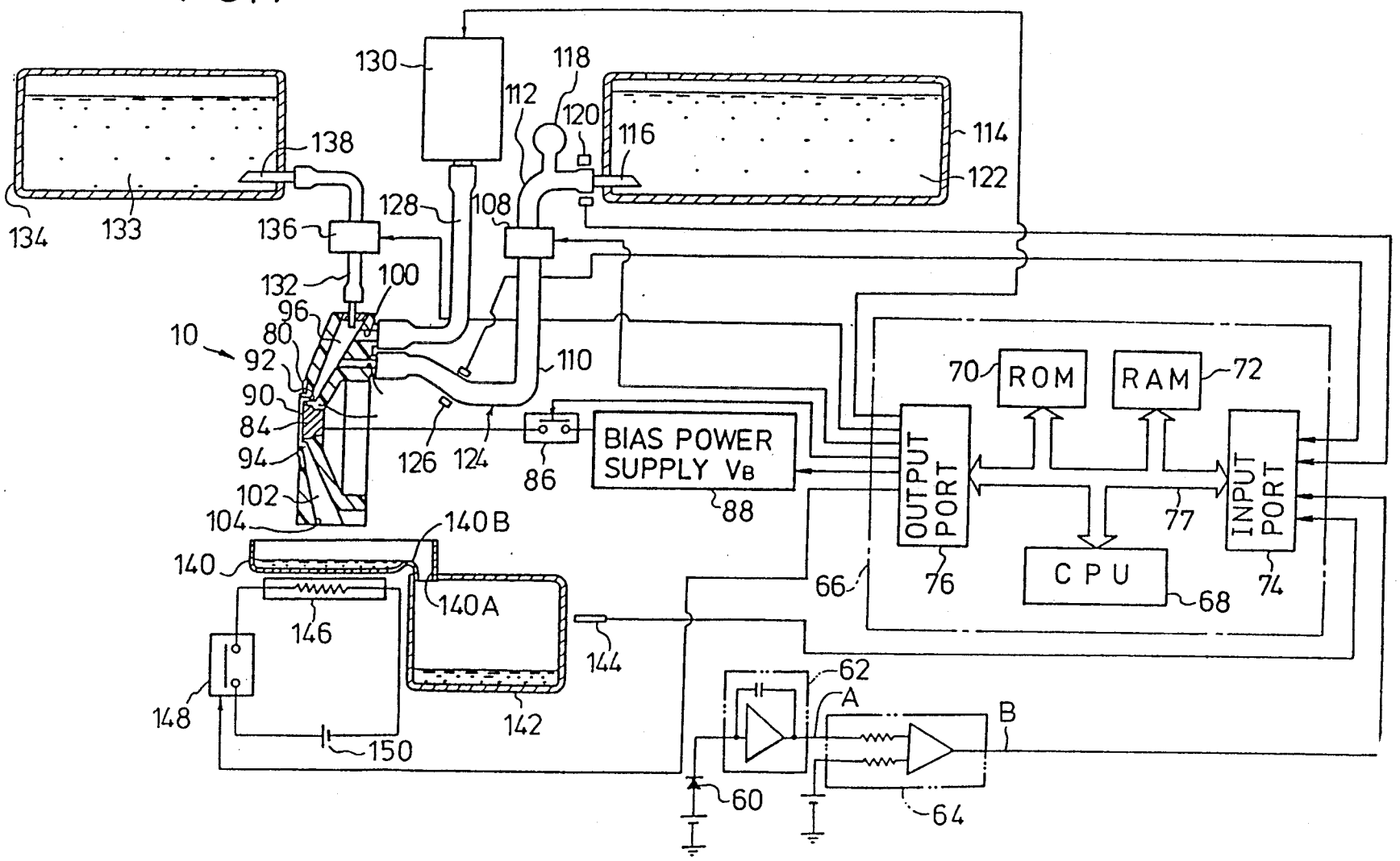
FIG. 1 is a block diagram showing the relationship between a developing zone of a processing head and other elements.
Figure 2:
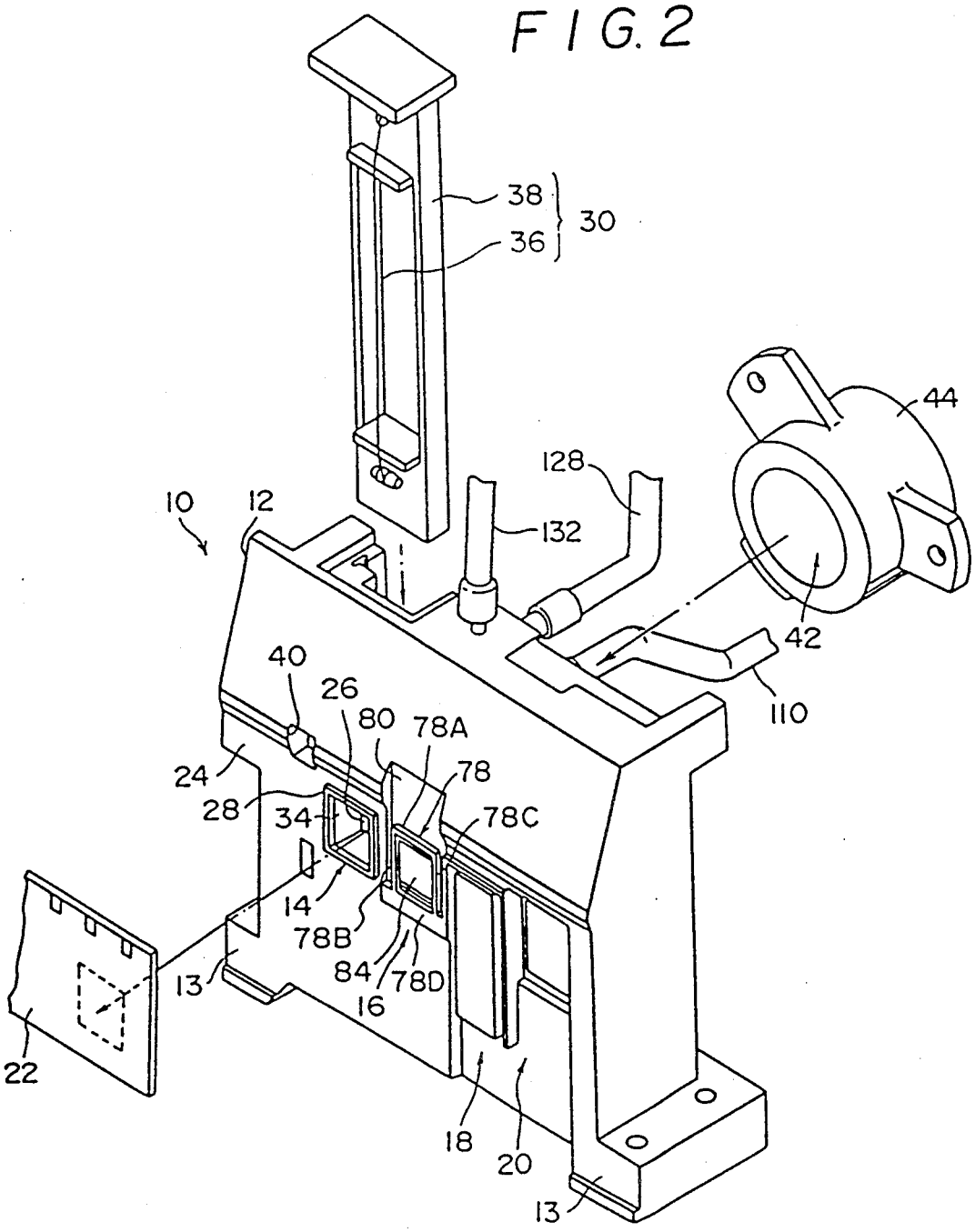
FIG. 2 is a perspective view of the processing head.

FIGS. 1 and 2 illustrate one embodiment of a processing head 10 which makes use of the present invention and is adapted to form microfilm images.

The illustrated processing head 10 is used to subject an electrophotographic film 2 as a microfilm to normal exposure to an original image and then to subject the resultant image to normal development, whereby the original image is recorded.

As depicted in FIGS. 1 and 2, the processing head 10 is integrally constructed of a relatively flattened and substantially rectangular main portion 12 and a pair of leg portions 13,13 located the main portion 12. Except for various attachments, they are formed as an integral unit with a synthetic resin.

As shown in FIG. 2, the main portion 12 of the processing head 10 is provided with charging and exposing zone 14, developing zone 16, drying zone 18 and fixing zone 20 which are formed in order along the width of the main portion at a constant pitch corresponding to the inter-frame interval of an electrophotographic film 22.

In the charging and exposing zone 14, the electrophotographic film 22 which corresponds to a frame thereof positioned therein there is charged and image light from an original is irradiated to expose the film thereto, so that an electrostatic latent image corresponding to the image pattern of the original is formed on the electrophotographic film 22. In the developing zone 16, the electrophotographic film exposed in the charging and exposing zone 14 is coated with a liquid developer to render the electrostatic latent image visible. In the drying zone 18, dry air is blown against the electrophotographic film 22 wetted with the liquid developer so as to dry off the moisture. In the fixing zone 20, the image is fixed on the electrophotographic film 22 by a fixing lamp or the like.

In the charging and exposing zone 14, a charging and exposing compartment 26 is formed in an internal cavity behind a front wall 24 of the processing head 10 as seen in FIG. 2. The charging and exposing compartment 26 opens in the front wall 24 of the processing head 10. A mask 28 which slightly protrudes from the front wall 24 is formed around the peripheral edge of the opening. The opening of the mask 28 has a rectangular shape of a size equivalent to each frame of the electrophotographic film. A corona unit 30, an unillustrated proximity electrode and a mask electrode 34 are disposed in the charging and exposing compartment 26.

As shown in FIG. 2, the corona unit 30 is constructed of a corona wire 36 and a synthetic resin holder 38 supporting the corona wire 36 thereon. The corona unit 30 is inserted downwardly from a top part of the processing head 10. The proximity electrode is formed of narrow metal strips, which are arranged on both sides of the corona wire 36 respectively. The mask electrode 34 has been formed by bending a metal plate into a square shape and is arranged in the vicinity of the opening of the front wall 24. The corona wire 36 is connected to a high voltage power supply, while the proximity electrode and mask electrode 34 are each connected electrically. In general, the proximity electrode is connected directly to the ground, while the mask electrode 34 is connected to the ground via an electric resistor. As an alternative, different bias voltages may be applied from an external power supply.

An film cooling air blowing opening 40 opens in the charging and exposing zone 14 as shown in FIG. 2. Cooling air is supplied by an unillustrated air pump to the opening by way of a tubing.

In addition, a main lens 42 whose optical axis is in registration with the center of the opening of the mask 28 is arranged on the rear wall side of the processing head 10. This main lens 42 is assembled in a lens mount and is secured to the processing head 10.

Figure 3:
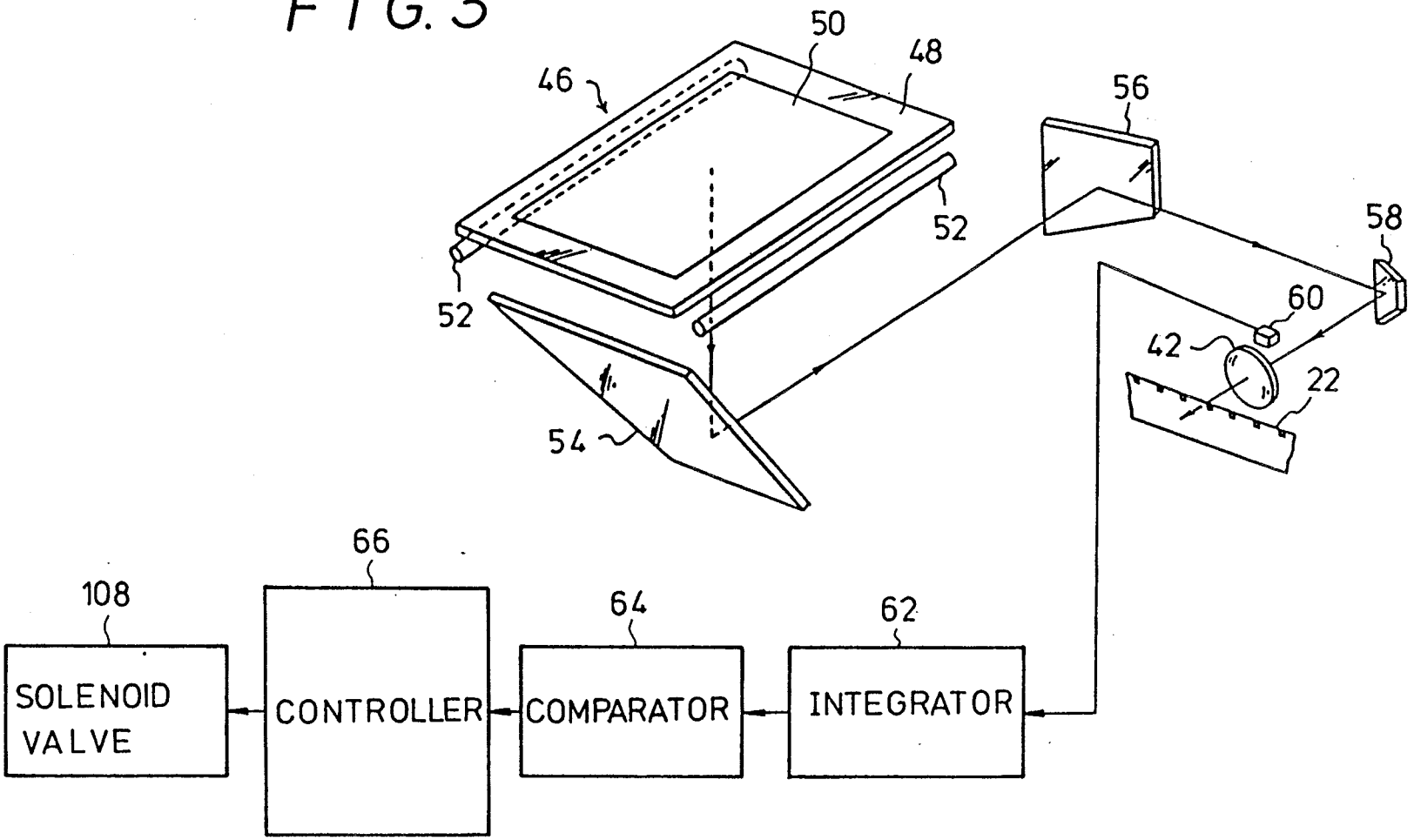
FIG. 3 is a perspective view showing the outline construction of a photographing optical system.

The main lens 42 constitutes a part of the photographing optical system shown in FIG. 3. The photographing optical system includes an original-illuminating lamp 52 for illuminating an original 50 as an object placed face down on a glass plate 48 of a copying table 46, a third mirror 54 for receiving light reflected by the original 50, a second mirror 56 for receiving light reflected by the third mirror 54, and a first mirror 58 for receiving light reflected by the second mirror 56. Owing to the main lens 42, the light reflected by the first mirror 58 is focused on the electrophotographic film 22.

Interposed between the main lens 42 and the first mirror 58 is a light quantity detector 60 for detecting the light quantity of light from the original 50. As shown in FIGS. 1 and 3, this light quantity detector 60 is connected to a controller 66 via an integrator 62 and a comparator 64. A photodiode or the like may be used by way of example as the light quantity detector 60.

The controller 66 is constructed, as shown in FIG. 1, CPU 68, ROM 70, RAM 72, input port 74 and output port 76, which are mutually connected by a data bus 77. The comparator 64 is connected to the input port 74.

As illustrated in FIGS. 1 and 2, a mask 78 is formed in the developing zone 16. The mask 78 includes upper frame 78 and side frames 78B, 78C, all of which extend upwardly from the bottom wall of a recessed portion 80 formed in the front wall 24. A lower frame 78D of the mask 78 extends at a lower side thereof upwardly from the front wall 24. Further, the lower frame 78D extends out at both end portions thereof beyond the points of connection with the side frames 78B, 78C. The upwardly-extending height of the mask 78 is designed to be such that the mask 78 lies in the same level as the mask 28.

The width of the opening of the mask 78 is very slightly shorter than the width of the opening of the mask 28. Since the inner wall of the lower frame 78D is located lower than the lower frame of the mask 28, the height of the opening, namely, the distance between the inner wall of the upper frame 78A and that of the lower frame 78D is longer correspondingly.

Inside the opening of the mask 78, a developing electrode 84 is supported on the rear wall 82 as shown in FIG. 1. The developing electrode 84 is connected to a bias power supply 88 via a relay 86. This relay 86 is normally closed to apply a bias voltage to the developing electrode 84. When the relay 86 is opened, the bias voltage is shut up. The relay 86 and bias power supply 88 are connected to controller 66.

The surface of the developing electrode 84 is located slightly inside the end face of the mask 78, so that the spacing surrounded by the developing electrode 84 and the inner walls of the mask 78 is used as a developing compartment 90. Each frame of the electrophotographic film 22 is pressed and exposed to the developing compartment 90 by means of an unillustrated pressure mechanism. The interval between the electrophotographic film and developing electrode 84 is set at such a dimension as enabling development of general characters, drawing or newspaper as an original, specifically, at 0.15–0.2 mm. Accordingly, this interval is set narrower than that the conventional interval. The developing electrode 84 is open at upper and lower parts thereof, which serve as a developer/ squeeze air stream inlet 92 and a developer/squeeze air stream output 94 respectively.

The developer/squeeze air stream inlet 92 is in communication with a passage 96 formed of an internal spacing of the processing head 10. The passage 96 is also in communication with a developer feed port 98 and a squeeze air stream feed port 100, which are both opening in the rear wall of the processing head 10. On the other hand, the developer/squeeze air stream outlet 94 is in communication with a passage 102 formed by an internal cavity of the processing head 10. The passage 102 is in communication with a developer/squeeze air discharge portion 104 opening in the lower wall of the processing head 10.

As is depicted in FIG. 1, the developer feed port 98 is connected to a developer tank 114 by tubings 110,112 with a solenoid valve 108 interposed at an intermediary point. The developer tank 14 is positioned at a level higher than the solenoid valve 108. A developer 122 is stored inside the developer tank 114. In the developer 122, "Isopar G" (trade mark; product of Esso Corp.) is used as a solvent and toner particles charged negative are mixed in the solvent. The concentration of the toner particles is set at 0.6 g/l. The tubing 112 upwardly terminates in a bottle penetration and liquid feed needle 116. The needle 116 is pushed in through a lower side wall portion of the developer tank 114, thereby communicating the tubing 112 and the developer tank 114 to each other. As these tubings 110,112, those having a diameter of 0.8–1.5 mm are used.

At an intermediary point of the tubing 112, a known air accumulator 118 such as that provided with a transfusion tube is provided for bubble elimination. A first flow sensor 120 is disposed along the tubing 110 at a point between the developer tank 114 and air accumulator 118. This first flow sensor 120 detects the presence or absence of toner particles contained in the developer 122 in the tubing 112, whereby it is detected whether the developer tank 114 contains the developer 122 or not. The first flow sensor 120 is connected to the input port 74 of the controller 66

The tubing 110 is connected at one end thereof to the solenoid valve 108 and extends vertically and downwardly. The tubing 110 is bent almost horizontally at an intermediary portion, whereby a bent portion is formed. The tubing 110 is at the other end thereof in communication with the developer feed port 98.

The portion of the tubing 110, which extends from the bent portion to the developer feed portion 98, lies lower than the developer feed port 98 and serves as a residual developer holding portion 124.

Between the residual developer holding portion 24 and developer feed port 98, a second flow sensor 126 is arranged. This second flow sensor 126 is adapted to detect the flow of toner particles in the developer 122 which passes through the tubing 110. Namely, the second flow sensor 126 detects that the developer is flowing through the tubing 110. This second flow sensor 126 is connected to the input port 74 of the controller 66.

The squeeze air feed port 100 is connected via a tubing 128 to an air pump 130 for pressurized squeeze.

The passage 96 is communicated to a rinse bottle 134 by way of a tubing 132 which extends through an upper wall of the main portion 12. At an intermediate point of the tubing 134, a rinse solenoid valve 136 is provided. This rinse solenoid valve 136 is connected to the output port 76 of the controller 66. On the other hand, a bottle penetration and liquid feed needle 138 is connected to the free end of the tubing 132 in much the same way as for the tubing 112. The needle 138 is pushed in through the side wall of the rinse bottle 134, thereby communicating the rinse bottle 134 and the passage 96 to each other. Stored as a rinse 133 within the rinse bottle 134 is "Isopar G" (trade mark, product of Esso Corp.).

A spent liquid pan 140 is disposed underneath the developer/squeeze air discharge port 104. A recovery port 104A is provided in a lower part of the spent liquid pan 140. A part of the peripheral edge of the recovery port 140A is bent inwardly of the spent liquid pan 140, in other words, protrudes in a direction that the depth of the pan becomes shallower, whereby a protruded portion 140B is formed. A bottom part, which is defined by the protruded portion 140B and the distal side wall, serves to receive any excess developer which could be discharged through the developer/squeeze air discharge port 104.

A recovery tank 142 is arranged underneath the recovery port 140A. Any excess developer, which could overflow the protruded portion 140B and could be discharged through the recovery port 140A, may be recovered in the recovery tank 142. Provided outside the recovery tank 142 is a level sensor 144, which is connected to the input port 74 of the controller 66. This level sensor 144 serves to detect the level of the developer recovered in the recovery tank 142 and then to send a corresponding signal to the controller 66.

A heater is arranged underneath the spent liquid pan 140. This heater 146 is connected to a power supply 150 via a relay 148. This relay 148 is also connected to the output port 76 of the controller 66.

In front of the front wall 24 of the processing head 10, an unillustrated pressure plate is arranged. This pressure plate is actuated by a pressure mechanism which is not shown, so that the electrophotographic film 22 is pressed against the front wall 24 of the processing head 10. In this case, the individual frames of the thus-pressed electrophotographic film 22 are positioned in and exposed to the charging and exposing zone 14, developing zone 16, drying zone 18 and fixing zone 20 respectively.

The developing process will next be described.

To the charging and exposing zone 14, developing zone 16, drying zone 18 and fixing zone 20 arranged side by side on the processing head 10, the individual frames of the electrophotographic film 22 are sequentially fed in the above order and processed there, so that the respective images are recorded on the electrophotographic film 22.

In this case, an unillustrated film feed motor is driven so that a desired frame chosen freely out of unrecorded frames is positioned on the front face of the mask 28 of the charging and exposing zone 14. This operation is performed by designating that desired frame by an unillustrated control keyboard through which an electrophotographic apparatus with the processing head 10 assembled therein is operated.

Let's now pay attention to the desired frame alone. Processing of the desired frame, in which the desired frame is fed from the charging and exposing zone 14 to the fixing zone 20 via the developing zone 16 and drying zone 18 to develop the frame and hence to record an image, will be described with reference to FIGS. 4, 5 and 6.

Figure 5A:
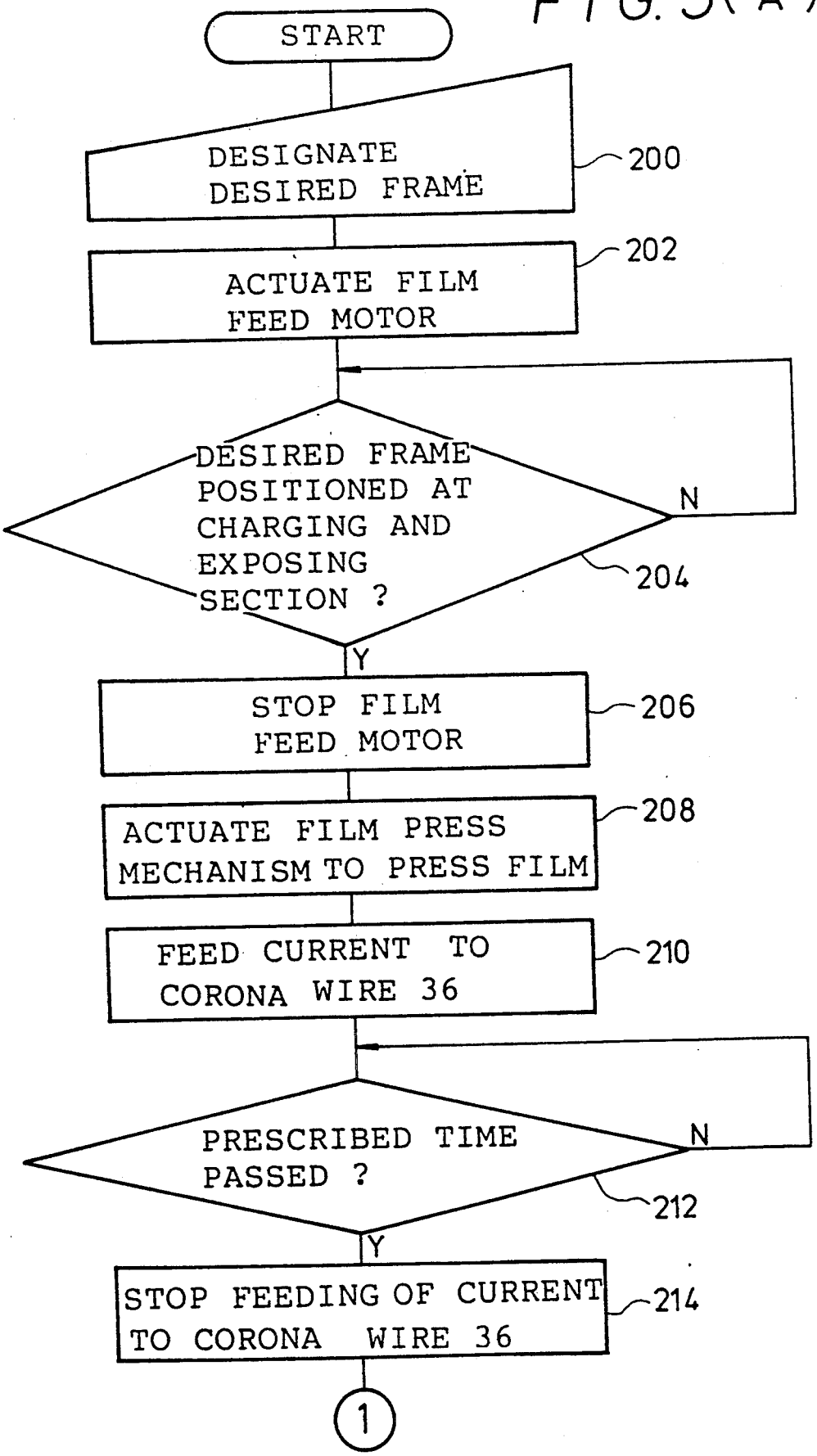
FIG. 5 is a flow chart showing operations in a charging and exposing zone.
Figure 5:
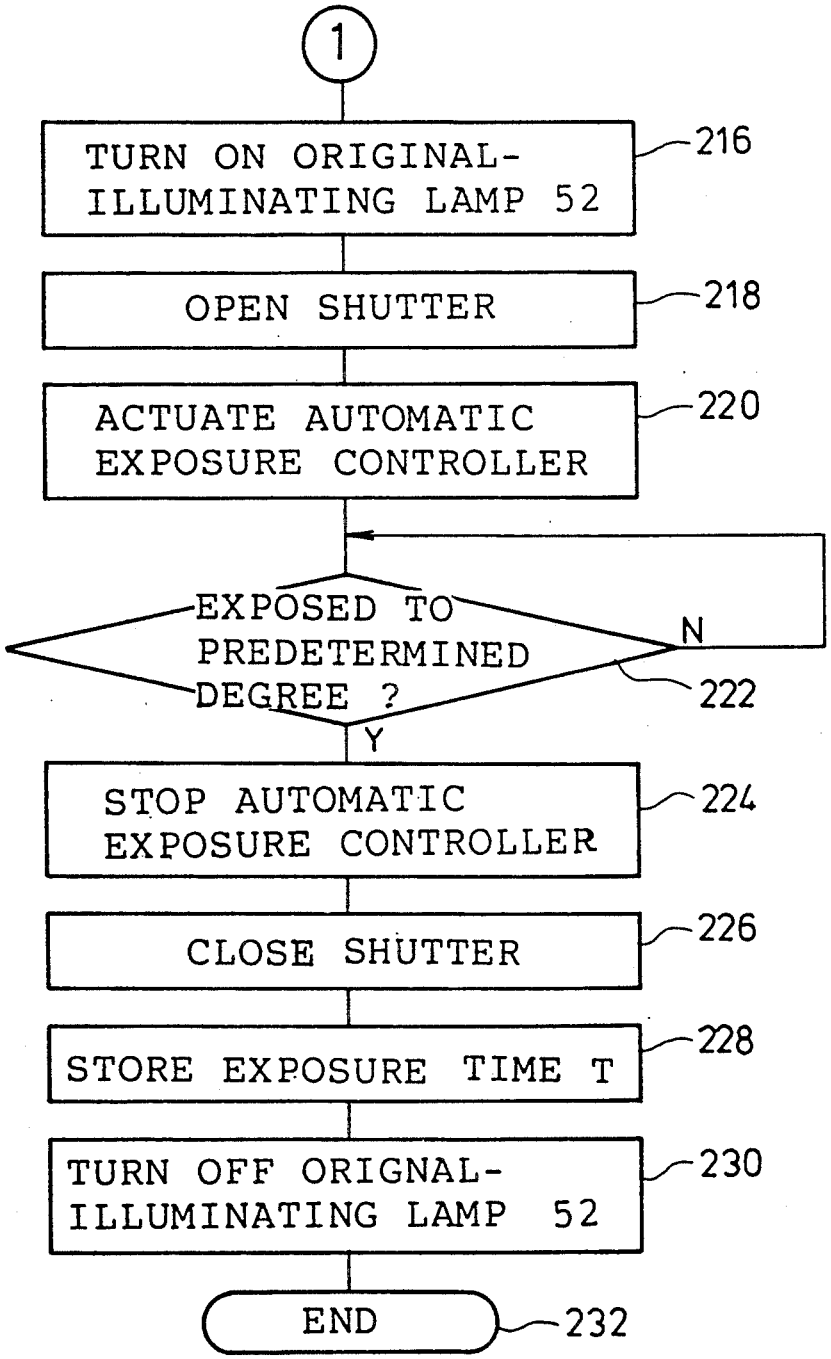

As illustrated in FIG. 5, the desired frame is designated out of unrecorded frames by the control keyboard (Step 200). The film feed motor is actuated by this designation (Step 202). In Step 204, a judgement is made as to whether the desired frame has been positioned in the charging and exposing zone 14. Upon positioning of the desired frame in the charging and exposing zone 14, the film feed motor is stopped, and the pressure mechanism is actuated and the film is pressed against and exposed to the charging and exposing zone (Steps 206,208).

The corona wire 36 is then fed with a current for a predetermined period of time and a high voltage is hence applied thereto, whereby a corona discharge takes place between the proximity electrode and mask electrode 34 (Steps 210, 212). As a result, the surface of a photo-sensitive layer of the electrophotographic film, said surface being positioned within the frame of the opening of the mask 28, is changed positive. Upon a lapse of a predetermined period of time, the feeding of the current to the corona wire 36 is stopped (Step 214). The original-illuminating lamp 52 is thereafter turned on so that light is irradiated onto the original 50 (Step 216). Upon irradiation of light to the original 50, the shutter is actuated and is opened. By the optical system depicted in FIG. 4, image light of the original 50 placed on the copying table 46 is irradiated through the main lens 42 onto the electrophotographic film 22 (Step 218). In addition, unillustrated automatic exposure controller starts cumulative addition of the light quantity of the image light from the original 50 (Step 220).

Figure 4:
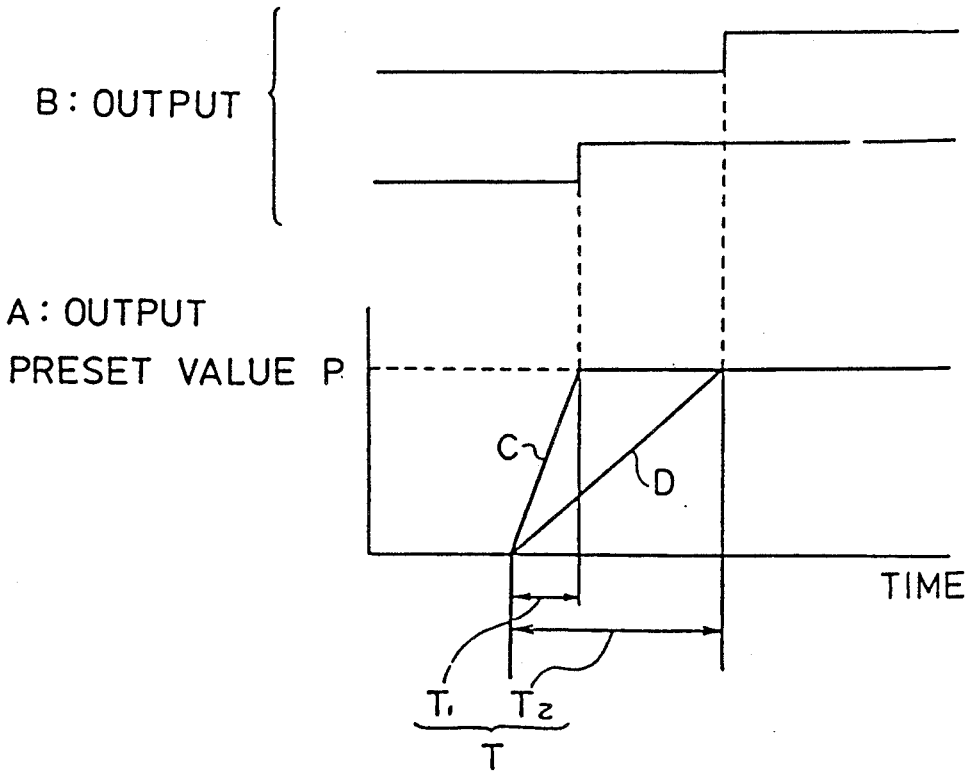
FIG. 4 is a diagram illustrating the output timing from a comparator as a function of exposure time.

Detection of this light quantity is performed by the light quantity detector 60. When the output A from the integrator 62 (see FIG. 1) reaches a preset value P as shown in FIG. 4, a signal (output B, see FIG. 1) is fed from the comparator 64 to the controller 66. Based on this signal, the automatic exposure controller is stopped and the shutter is closed (Steps 222,224, 226). Here, the time (exposure time) from the opening of the shutter by the controller 66 to initiate the exposure of the electrophotographic film 22 until the time that the exposure has reached the preset value P, in other words, until the time that the shutter is closed by the controller 66 is measured (Step 228).

This exposure time T is longer ($T_2$) as shown by line D in FIG. 4 when the original 50 has black areas in a higher proportion relative to the entire areas, in other words, has a high optical density compared to a situation where the original 50 has black areas in a lower proportion relative to the entire areas, in other words, has a low optical density. Where the optical density is lower, the exposure time T becomes shorter ($T_1$) as shown by line C in FIG. 4.

The original-illuminating lamp 52 is turned off in Step 230, so that charging and exposure of the electrophotographic film 22 is completed (Step 232). At this point, an electrostatic latent image has been formed on the frame of the electrophotographic film 22, said frame being located over the opening of the mask 28, because charges on the photosensitive layer have decreased in accordance with the image pattern of the original 50.

The frame of the electrophotographic film 22, said frame carrying the electrostatic laten image formed thereon in the charging and exposing zone 14, is fed to the developing zone 16 for its development.

Figure 6:
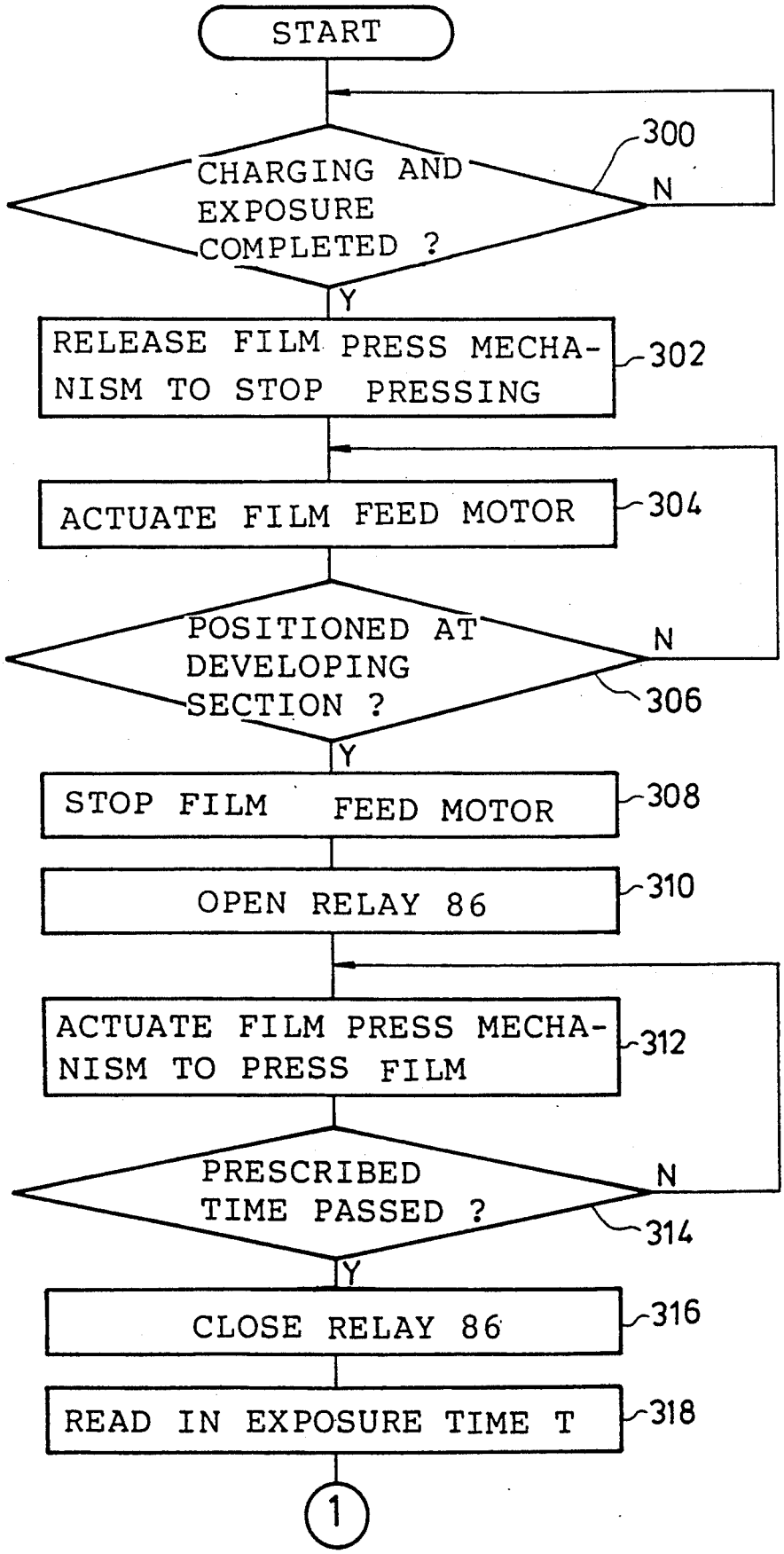
FIG. 6 is a flow chart showing operations in the developing zone.
Figure 6:
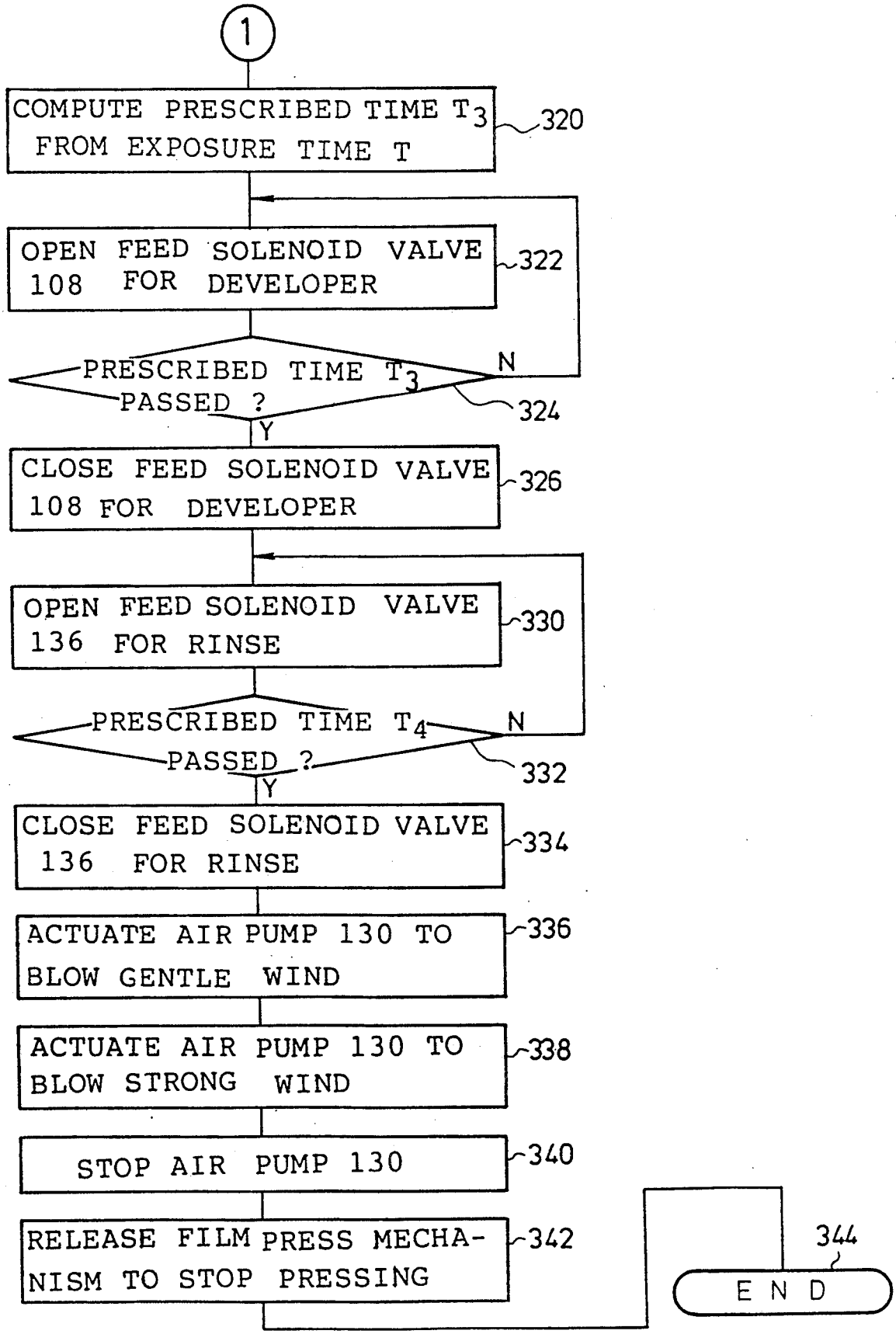

Developing steps of the frame of the electrophotographic film 122 will hereinafter be described in accordance with the flow chart illustrated in FIG. 6.

It is judged in Step 300 whether the charging and developing have been completed or not. Unless the charging and developing have been completed, this judgement is performed repeatedly.

When the charging and developing have been completed and an electrostatic latent image has been formed on the electrophotographic film 22, the pressing of the film by the pressure mechanism is released and the unillustrated film feed motor is actuated (Steps 302,304). As a result, the frame with the electrostatic static latent image formed thereon is moved from the charging and exposing zone. In Step 306, it is judged whether the desired frame has been positioned in the developing zone 16 as a result of the above movement. If the desired frame has not yet been placed in the developing zone 16, the film feed motor is allowed to operate continuously. Upon positioning of the desired frame in the developing zone 16, the film feed motor is stopped (Step 308).

Prior to actuation of the pressure plate, the relay 86 is rendered open from its normal closed position so as to stop the application of the bias voltage to the developing electrode 84 (Step 310). Upon stopping of the film feed motor, the pressure mechanism is actuated so that the electrophotographic film 22 is pressed against and exposed to the developing compartment 90 (Step 312). A prescribed time H, in which the application of the bias voltage is stopped, is set at about 30 msec. This prescribed time is considered to be equal to the time required for the substantial attenuation of vibrations of the electrophotographic film 22 when the film 22 is pressed against the mask 78 of the processing head 10 by the pressure mechanism. This time H has made it possible to avoid such a problem that the electrophotographic film 22 may accidentally approach the developing electrode too much and a discharge may be produced between the electrophotographic film 22 and the developing electrode 84. Unless the prescribed time H has not elapsed, the relay 86 remains open. As soon as the prescribed time H has elapsed, the relay 86 is closed (Step 316). As a result, the bias voltage is again applied to the developing electrode 84.

Figure 7:
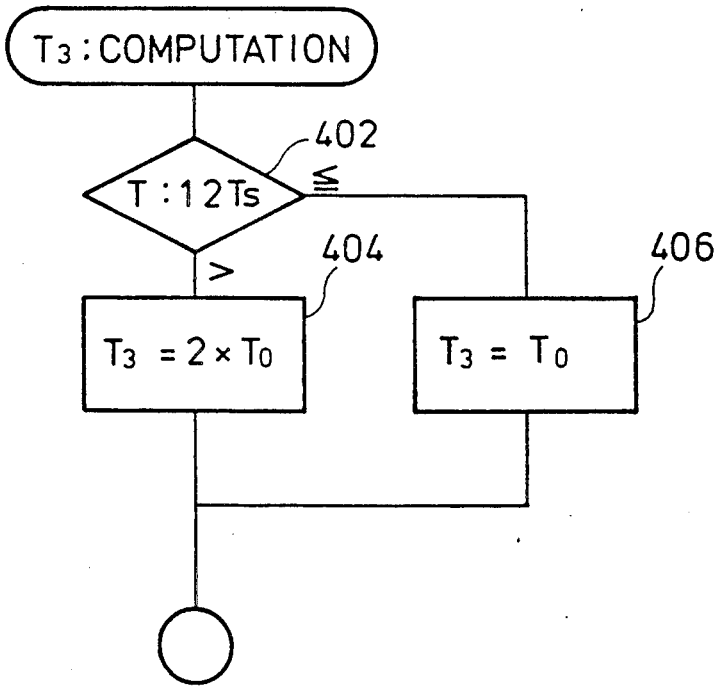
FIG. 7 is a flow chart illustrating the setting of open time of a solenoid valve.

After the electrophotographic film 22 has been pressed against and exposed to the developing compartment 90, the exposure time T is read in (Step 318). From the exposure time T thus read in, an opening time $T_D$ of the solenoid valve 108 is computed (Step 320). For this computation, the routine shown in FIG. 7 is performed.

It is judged in Step 402 whether the exposure time T thus read in is longer or shorter than 1.2 times the standard exposure time $T_S$. When $T > 1.2T_S$, the opening time $T_D$ of the solenoid valve 108 is set at $2T_O$, Where $T_O$ means the standard open time of the solenoid 108 corresponding to the standard exposure time $T_S$. When $T < 1.2T_S$ on the other hand, the open time is set at $T_O$ in Step 406.

The developer feeding solenoid valve 108 is opened for the opening time $T_D$ set as described above (Steps 322,324).

When the electrophotographic film 22 positioned in the developing zone 16 bears an image of an original of a high optical density as a result of its charging and exposure, the opening time $T_D$ of the solenoid valve 108 is set longer so as to feed more developer 122 to the developing compartment 90. When an image of an original of a low optical density has been formed by charging and exposure, the opening time $T_D$ of the solenoid 108 is set shorter so as to fees less developer 122. It is hence possible to feed the developer in a minimum necessary quantity, whereby a film exposed to image light from the original 50 can be developed without failure irrespective of the optical density of the original 50.

In the present embodiment, images recorded on the electrophotographic film are microimages. For example, the area of each frame of the film, namely, each image is 1 $cm^2$. In accordance with the image pattern of the original whose image is to be recorded, toner particles in the corresponding quantity shown below in Table 1 are attracted to the electrostatic latent image thereby to render the electrostatic latent image visible. Next to each toner particle quantity given below in Table 1, there is also shown the quantity of the developer required to feed the toner particle quantity. The quantity of the toner particles in the developer has been experimentally determined to be about 3 times the corresponding quantity of the toner particles.

TABLE 1

| Kind of original | Quantity of toner attracted | Quantity of toner required |
|---|---|---|
| General characters, drawings | 2–3 μg | 6–9 μg |
| Newspapers | 5–8 μg | 15–24 μg |
| Photographies, contact prints | 10–35 μg | 30–115 μg |

According to the above table, general characters and drawings have a low optical density as originals, while photographies and contact prints have a high optical density as originals. Let's assume by way of example that the standard quantity of the developer per image (frame) be 0.05 g. This developer contains about 43 μg of toner particles. This toner particle quantity is sufficient in view of the above table. More toner particles are however required for photographies and contact prints. The standard quantity of the developer may hence be insufficient, leading possibly to development blurs. To cope with this potential problem, the opening time $T_D$ of the solenoid valve 108 is prolonged in accordance with the quantity of light from the original in this embodiment so that the feed quantity of the developer is increased and an electrostatic latent image of an original of a high optical density such as a photograph or contact print can still be developed without failure.

Figure 8:
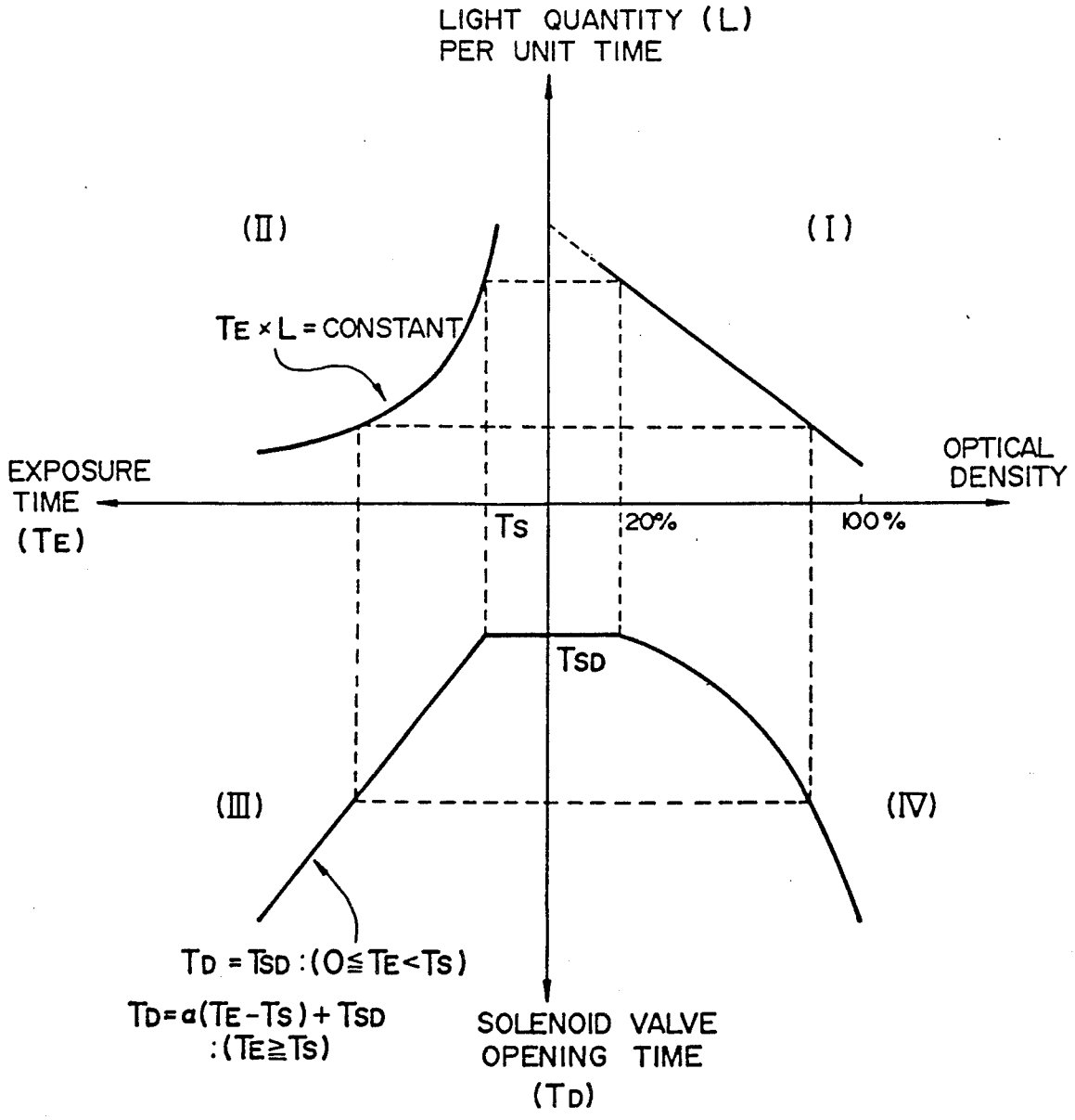
FIG. 8 is a diagram showing relation between light quantity, exposure time, solenoid valve opening time and an optical density of an original.

The open time $T_D$ of the solenoid valve 108 has been set above by assuming that the standard quantity of the developer is 0.05 g. The above method is a stepwise method in which the open time $T_D$ of the solenoid 108 is set by multiplying the preset and stored standard open time $T_s$ with a factor which is set in accordance with the light quantity. The present invention is however not necessarily limited to the use of this method. The open time $T_D$ of the solenoid valve 108 may be controlled continuously in accordance with the light quantity of image light from an original. One example of this method will next be described with reference to FIGS. 8. FIG. 8 shows respective relations between the light quantity L per unit time of image light from the original and the optical density in the quadrant I, the light quantity L and exposure time $T_E$ in the quadrant II, the exposure time $T_E$ and solenoid valve opening time $T_D$ in the quadrant III, and the solenoid valve opening time $T_D$ and the optical density in the quadrant IV. The light quantity L is changed in accordance with variation of the optical density as shown in the quadrant I, and the exposure time $T_E$ is predetermined to maintain the product of the light quantity L and the exposure time $T_E$ constant by automatic exposure control as shown in the quadrant II. The solenoid valve opening time $T_D$ is predetermined with the relation shown in the quadrant III toward the exposure time $T_E$ in accordance with an operation program for the developing time, and consequently the quantity of the developer is controlled.

In other words, as disclosed in the following equation (1), the solenoid valve opening time $T_D$ is set to time or standard time $T_{SD}$ in case that the exposure time $T_E$ is below the time or standard time $T_S$, and the solenoid valve 108 is opened in correspondence to this time and the developer is accordingly supplied to the developing zone 16.

When the exposure time $T_E$ exceeds the standard time $T_S$, the solenoid valve opening time T is increased relative to the exceeded amount of the time as shown in the equation (2), and the amount of the developer is increased and is supplied to the developing zone 16.

$$T_D = T_{SD}\ (0 \leqq T_E < T_S) \ldots (1)$$

$$T_D = \alpha(T_E - T_S) + T_{SD}\ (T_E \geqq T_S) \ldots (2)$$

where $\alpha$ is a proportional constant.

The open time can be continuously controlled by predetermining and controlling the opening time $T_D$ of the solenoid valve 108 as illustrated in FIG. 8.

When the solenoid valve 108 whose open time $T_D$ has been set as described above is opened, the developer 122 naturally flows down from the developer tank 114 through the tubings 112,110 to the processing head 10, so that the developer 122 flows into the developing compartment 90 through the developer/squeeze air stream inlet 92.

In the case of the first development, neither the tubing 110 nor the residual developer holding portion 124 is filled with the developer. It is accordingly necessary to prolong the open state of the solenoid valve 108 by the time required to fill the tubing 110 and residual developer holding portion 124 with the developer. The residual developer holding portion 124 is provided with the second flow sensor 126 of the charging type, thereby detecting whether the tubing 110 is filled with the developer or not. In the first development, the solenoid valve 108 is closed upon an elapsed time of the prescribed time $T_D$ after the developer has been detected by the second flow sensor 126. It is hence possible to avoid insufficient development which may otherwise be caused due to a delay in the feeding of the developer. Upon feeding of the developer, toner particles dispersed in the developer and charged negative are attracted to areas of the electrophotographic film, said areas being charged positive, whereby the electrostatic latent image is rendered visible. The excess developer 122 which has been fed to the developing compartment 90 and has flowed downwards through the developing compartment 90 flows from the developer/squeeze air stream outlet 94 through the passage 102 and developer/squeeze air discharge port 104 into the spent liquid pan 140. The excess developer 122 discharged into the spent liquid pan 140 is heated and dried by the heater 146 so that the solvent component is evaporated. When a lot of excess developer is discharged into the spent liquid pan 140, in other words, when development is performed frequently, the spent liquid pan 140 may not be able to store it where the surrounding temperature is particularly low and the evaporation is little. In this case, the developer overflows the protruded portion 140B and is recovered through the recovery port 140A into the recovery tank 142. Upon normal use (when the surrounding temperature is not particularly low), the developer never overflows the protruded portion 140B. Upon an elapsed time T since the solenoid valve 108 has been opened, the solenoid valve 108 is closed in Step 326.

After the closure of the solenoid valve 108, the rinse solenoid valve 136 is opened for the prescribed time $T_4$ in Step 330. Owing to the opening of the rinse solenoid valve 136, the rinse 133 is fed from the rinse bottle 134 to the developing compartment 90. Any excess developer stuck on the developing electrode 84 is washed away by the rinse 133 and is discharged along with the rinse 133 into the spent liquid pan 140. The rinse 133 and excess developer, which have been discharged into the spent liquid pan 140, are heated by the heater 146 and are thus dried and evaporated.

Upon an elapsed time of the prescribed time $T_4$ since the rinse solenoid valve 136 has been opened, the rinse solenoid valve 136 is closed (Step 334). Simultaneously with the closure of the rinse solenoid valve 136, the squeezing air pump 130 depicted in FIG. 1 is actuated to feed pressurized air from the squeeze air feed port 100 to the developing compartment 90 (Steps 336,338), so that excess developer 122 still adhering on the electrophotographic film 22 is blown away. The developer 122 blown away is discharged to the spent liquid pan 140.

The feeding of the pressurized air to the developing compartment 90 is controlled to give a gentle wind while excess developer is left sufficiently in the developing compartment 90 (Step 336). This can avoid deterioration of the image due to high-speed blow off. Upon a lapse of a prescribed time since the feeding of air has been started, the gentle wind is changed to a strong wind (Step 338). The actuation of the air pump 130 is stopped (Step 340) to stop the feeding of the pressurized air, and the holding of he film by the pressure mechanism is released (Step 342). Accordingly, the development in the developing zone is completed (Step 344). The film feed motor is driven to move the electrophotographic film by one frame, so that the frame which has assumed the developing zone 16 is positioned in the drying zone 18. After the film feed motor has stopped, the pressure mechanism is actuated and upon an elapsed time of a prescribed time, warn air is blown into the drying zone 18 to dry the developer 118. Simultaneously with release of the holding of the electrophotographic film 22 in the drying zone by the pressure mechanism, the feeding of the warm air is stopped to complete the drying step.

The film feed motor is next driven to move the frame fro the drying zone 18 to the fixing zone 20. After the drive of the film feed motor has been stopped, the pressure mechanism is actuated and at the same time, cool air is fed to the fixing zone 70.

Upon an elapsed time of a prescribed time since the pressure mechanism has been actuated, an unillustrated xenon lamp is turned on to fuse and fix the toner particles on the surface of the electrophotographic film 22 to complete the fixing step. By completing all the above steps, the development of the electrophotographic film 22 is achieved to complete the recording of the image.

Upon completion of all the processings, the tubings 112,110 and residual developer holding portion from the developer tank 114 to the developer feed port 98 are filled with the toner slurry.

If the toner slurry is left over for a long period of time while placed in the tubings, the toner particles dispersed in the slurry are allowed to settle so that the concentration of the toner becomes uneven in the tubings. It is hence not preferred to left over the toner slurry for such a long period of time. After completion of all the steps, the pressure plate is hence pressed against the front face of the processing head 10, the air pump 130 is operated, and then the solenoid valve 108 is maintained closed for 2–3 seconds. By using the air pressure of the air pump 130, the developer in the developer feed port 98, tubings 110,112 and the residual developer holding portion 124 is returned to the developer tank 114 and the solenoid valve is then closed. The air pump 130 is stopped and the pressure plate 108 is released.

It has been known that the developer undergoes less settling in the developer tank 114 than in the tubings. It is also possible to prevent the settling completely by using a certain stirring means (not shown).

The developer which has not been drawn out of the tubings by the above operation still remains in the tubings. However, the residual developer holding portion 124 located at the position lower than the other tubings is provided in the present embodiment. Therefore, any remaining developer gathers in the residual developer holding portion 124. The residual developer holding portion 124 is connected to the developer feed port 98 via a narrow tubing portion of 0.8–1.5 mm in diameter and permits substantially no evaporation of the developer. It is hence not necessary to worry about the possible blocking of the tubings due to drying and solidification even if the developer remains.

Normal development has been described in the present embodiment. This invention can however be applied to reversal development. In this case, the feed quantity of the developer is reduced when the optical density of an original is high, while the feed quantity of the developer is increased when the optical density of an original is low.

Although the light of the original-illuminating lamp was irradiated onto an original and the quantity of the light reflected by the original was measured in the above embodiment, this invention is not necessarily limited to this. Light may be downwardly irradiated to an original and the quantity of light transmitted through the original may then be measured. Needless to say, it may also be possible to measure the quantity of light which is a mixture of transmitted light and reflected light.

What is claimed is:

1. A process for developing a film, which carries an electrostatic latent image formed by exposing the film in a charged state to image-bearing light from an original, by feeding a liquid developer to the film in a film developing compartment via a liquid delivery means, said film having a plurality of frames, each of said frames having an image portion, corresponding to said electrostatic latent image, and a background portion, said process comprising the following steps:

(a) electrifying a predetermined area for one frame;
(b) exposing said one frame;
(c) developing all of said one frame at the same time after said step (b);
(d) integrating and detecting the quantity of light from both the image portion and background portion of said one frame over substantially all of the predetermined area; and
(e) controlling the quantity of liquid developer fed to the film developing compartment via the liquid delivery means for developing said one frame in a field to be developed, in accordance with said step (d).

2. A process as claimed in claim 1, wherein the control of the feed quantity of the liquid developer is achieved by changing the feed time.

3. A process as claimed in claim 2, wherein the process is applied for normal development, and in step (e), the feed quantity of the liquid developer is controlled in such a way that the feed quantity of the liquid developer is decreased in relation to an increase in the quantity of the light detected in step (a) but is increased in relation to a decrease in the quantity of the light detected in step (d).

4. A process as claimed in claim 3, wherein the control in step (e) modifies the quantity of liquid developer in a continuous relation to changes in light quantity.

5. A process as claimed in claim 3, wherein the control in step (e) modifies the quantity of liquid developer in a stepwise relation to changes in light quantity.

6. A process as claimed in claim 2, wherein the process is applied for reversal development, and in step (e), the feed quantity of the liquid developer is controlled in such a way that the feed quantity of the liquid developer is increased in relation to an increase in the quantity of the light detected in step (d) but is decreased in relation to a decrease in the quantity of the light detected in step (d).

7. A process as claimed in claim 6, wherein the control in step (b) modifies the quantity of liquid developer in a continuous relation to changes in light quantity.

8. A process as claimed in claim 6, wherein the control in step (e) modifies the quantity of liquid developer in a stepwise relation to changes in light quantity.

9. A process as claimed in claim 2, wherein the detection of the light quantity in step (d) is effected by detecting light reflected by the original or light transmitted through the original.

10. A process for developing a microfilm which carries an electrostatic latent image formed by exposing the film in a charged state to image-bearing light from an original, by positioning the microfilm in opposition to a developing electrode at a prescribed interval between the microfilm and the developing electrode and feeding a liquid developer to the film in a film development compartment via a liquid delivery means into the spacing between the developing electrode and microfilm, said microfilm having a plurality of frames, each of said frames having an image portion, corresponding to said electrostatic latent image, and a background portion, said process further comprising the following steps:

(a) electrifying a predetermined area for one frame;
(b) exposing said one frame;

(c) developing all of said one frame at the same time after said step (b);

(d) integrating and detecting the quantity of light from both the image portion and background portion of said one frame over substantially all of the predetermined area; and (e) controlling the quantity of liquid developer fed to the film developing compartment via the liquid delivery means for developing said one frame in a field to be developed, in accordance with said step (d).

11. The process as claimed in claim 10, wherein the control of the feed quantity of the liquid developer is achieved by changing the feed time.

12. A process as claimed in claim 11, wherein the process is applied for normal development, and the feed quantity of the liquid developer is controlled to a first predetermined quantity when the quantity of the light detected in step (d) falls within a prescribed range but is controlled to a second predetermined quantity, which is greater than the first predetermined quantity, when the quantity of the light detected in step (d) is smaller than the lower limit of the prescribed range.

13. A process as claimed in claim 11, wherein the process is applied for reversal development, and the feed quantity of the liquid developer is controlled to a first predetermined quantity when the quantity of the light detected in step (d) falls within a prescribed range but is controlled to a second predetermined quantity, which is greater than the first predetermined quantity, when the quantity of the light detected in step (d) is greater than the upper limit of the prescribed range.

14. A process as claimed in claim 11, wherein the detection of the light quantity in step (d) is effected by detecting light reflected by the original or light transmitted through the original.

15. A developing apparatus for developing a film, which carries an electrostatic latent image formed by exposing the film in a charged state to image-bearing light from an original, by feeding a liquid developer to the film in a film developing compartment, via liquid delivery path, said film having a plurality of frames, each of said frames having an image portion, corresponding to said electrostatic latent image, an a background portion, comprising:

means for electrifying a predetermined area for one frame;

means for exposing said one frame;

means for developing all of said one frame at the same time after said step (b);

means for integrating and detecting the quantity of the light from both the image portion and background portion of said frame over substantially all of the predetermined area;

means within said liquid delivery path for feeding the liquid developer to the film; and means for controlling the developer feeding means in accordance with the light quantity detected by the integrating and detecting means, so as to control the feed quantity of the liquid developer to the film developing compartment for developing said one frame in a field to be developed.

16. The developing apparatus as claimed in claim 15, wherein the control means controls the feed time of the developer by the liquid developer feeding means so as to control the feed quantity of the liquid developer.

17. The developing apparatus as claimed in claim 16, wherein liquid the developer feeding means is equipped with a developer tank for storing the liquid developer and a valve for feeding the liquid developer from the liquid developer tank to the film when opened.

18. The developing apparatus as claimed in claim 17, wherein the control means controls the open time of the valve so as to control the feed quantity of the liquid developer.

19. The developing apparatus as claimed in claim 18, wherein the control means controls the open time of the valve in a continuous relation to the quantity of the light detected by the detection means.

20. The developing apparatus as claimed in claim 18, wherein the control means controls the open time of the valve stepwise in a stepwise relation to the quantity of the light detected by the detection means.

* * * * *